United States Patent [19]

Grass

[11] Patent Number: 4,979,265

[45] Date of Patent: Dec. 25, 1990

[54] WIDE ANGLE HINGE WITH GEAR DRIVE

[75] Inventor: Alfred Grass, Hochst/Vlbg., Austria

[73] Assignee: Grass AG, Hochst/Blbg., Austria

[21] Appl. No.: 348,838

[22] Filed: May 8, 1989

[30] Foreign Application Priority Data

May 6, 1989 [DE] Fed. Rep. of Germany ..... 3815450

[51] Int. Cl.[5] ..... E05D 7/00

[52] U.S. Cl. ..... 16/291; 16/308; 16/354; 16/79; 16/73; 16/75; 16/DIG. 36; 16/DIG.43

[58] Field of Search ..... 16/79, 286, 291, 293, 16/308, 354, DIG. 36, DIG. 43, 73, 75

[56] References Cited

U.S. PATENT DOCUMENTS

| | | | |
|---|---|---|---|
| 283,416 | 8/1883 | Pattison | 16/354 |
| 1,998,319 | 4/1935 | Johnson | 16/354 |
| 2,078,815 | 4/1937 | Segar | 16/354 |
| 4,684,158 | 8/1987 | Miclot | 16/354 |

FOREIGN PATENT DOCUMENTS

| | | | |
|---|---|---|---|
| 424120 | 1/1926 | Fed. Rep. of Germany | 16/354 |
| 2459346 | 7/1976 | Fed. Rep. of Germany | 16/354 |
| 1559893 | 6/1978 | Fed. Rep. of Germany | 16/354 |

*Primary Examiner*—Richard K. Seidel
*Assistant Examiner*—Edward A. Brown

[57] ABSTRACT

A wide angle hinge is used for articulation of a furniture door on a furniture unit with a base plate mounted on the furniture unit and a housing mounted on the furniture door; mounted on the base plate is a first gear rack on which a gear is rolled in the longitudinal direction of the hinge and meshes with a second gear rack connected with the housing. The second gear rack is mounted directly on the housing and has a circular arc shape that is concentric with the swivel axis of the door.

10 Claims, 3 Drawing Sheets

WIDE ANGLE HINGE WITH GEAR DRIVE

BACKGROUND OF THE INVENTION

The invention relates to a wide-angle hinge with gear drive as described in the classifying portion of claim 1.

A wide-angle hinge of this type has been disclosed, for example, with the subject matter of Swiss Patent No. 480,525. The gear described in this patent meshes with a straight gear rack connected with the base plate as well as with another gear rack, also straight, that is mounted on a longitudinally displaceable slide arranged in the hinge. The slide is moved through a guide lever pivotally connected at its one end with the forward side of the slide on the furniture door side and at its other end with the pivoting part of the housing sunk into the furniture door.

There is a second bearing point between the slide and the housing on the furniture door side so that, when the door is opened, the guide lever is extended, the slide being displaced in the hinge in the longitudinal direction thereof, and the gear thus rolls at the same time on the gear rack at the base plate side.

One disadvantage of this known wide-angle hinge is the fact that a separate guide lever has to be used for displacing the slide arranged to displace in the housing, which entails greater manufacturing costs and greater wear in operation.

A further disadvantage is that only a single gear is used with the resulting requirement for relatively long and thus costly gear racks on the base plate and in the slide when the opening angle is more than 90°.

The subject matter of German Published patent Application No. 15 59 893 does suggest using a gear rack that turns concentrically with the bearing axis instead of a straight gear rack that moves the slide. However, this known wide-angle hinge also has a number of guides and one of them even has to be conducted in a slide-bar, which entails high manufacturing costs and the associated wear.

SUMMARY OF THE INVENTION

The objective of the invention is thus to develop a wide-angle hinge of the type mentioned in the beginning so as to provide a hinge that is as simple as possible, economical to manufacture and low in wear.

This objective is achieved in that the hinge is characterized by the instruction presented in claim 1.

A feature of the present invention is that only a single articulating point is needed with a connecting guide being eliminated. This articulating point is arranged in the housing itself on the furniture door side, and the slide acts directly on this articulating point through an offset.

The use of a gear rack bent in a circular arc concentric with the articulating point results in a surprisingly simple structure with a minimum of moving parts.

In addition, none of the known wide-angle hinges has an opening and closing pressure device that keeps the hinge in a spring-loaded open position on opening and in a spring-loaded closed position on closing.

The invention suggests a simple closing pressure device embodied in the arrangement on the gear of an eccentric crankpin on which one end of a spring component is attached, the other end being connected with the slide.

Once the gear itself is mounted on the slide as well, the structure has a top dead center such that the spring component exerts a spring pressure in the direction below the center line when the gear is turned into a sector below its center line and, conversely, when the gear is turned over its center line, the spring component snaps over this center line and then exerts a spring pressure in the direction over this center line.

Thus, spring pressure is exerted on the furniture door in both the closed and open positions.

However, it is important that the closing pressure device is in action in only a sector of less than 90° of the angle of swivel of the door so that, outside this sector, the door can swivel completely free of the action of the closing pressure device, while the closing and opening pressure device is in action in only a swivel angle sector of about 45° to 0°.

During the swivel motion of the door from the open position to the closed position, therefore, the closing pressure device also has an attenuating action in the closing angle sector of about 45° to 10°, the closing pressure device then coming into action in the last 10° of swivel (in that the spring component snaps beyond the center line of the turning gear) and the door is then pre-loaded by the spring component in this sector in the direction of the closed position.

A further essential advantage of the present invention relates to the provision of not just one but rather two gears with different diameters, the gear with the larger diameter rolling on the straight gear rack on the furniture unit side and the smaller gear rolling on the gear rack on the furniture door side. This gives the advantage of a transmission gear, which means that use can be made of considerably shorter gear racks and therefore considerably lower costs in manufacturing the hinge according to the invention.

Further advantages and features are the subject matter of the rest of the sub-claims.

The subject matter of the present invention follows not only from the subject matter of the individual patent claims but also from the combination of the individual patent claims with each other. All information and features disclosed in this documentation, including the abstract, particularly the configuration shown in the drawings, are claimed as essential to the invention as far as they are new compared to the art, either individually or in combination.

The invention is explained in more detail below using a number of drawings illustrating embodiments. The drawings and their description will indicate further features essential to the invention as well as further advantages of the invention.

DESCRIPTION OF THE PREFERRED EMBODIMENT

Figure 1:
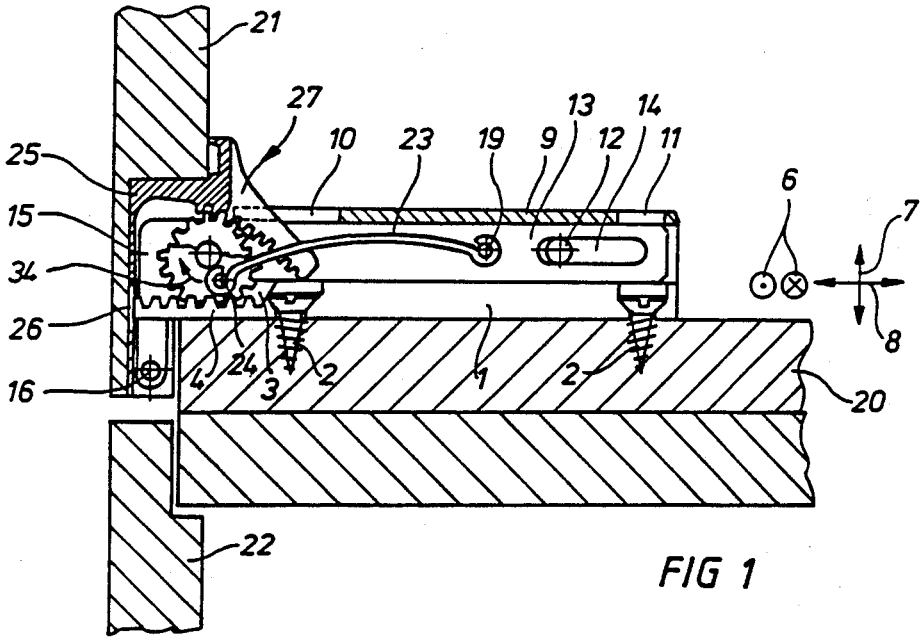
FIG. 1 is a schematic view in section of an embodiment of the hinge in the closed position.

In FIG. 1, a base plate 1 is mounted with screws 2 on a furniture unit.

The hinge shown here can obviously be connected with hinge displacement devices that are known per se, and the base plate 1 mounted on the furniture unit 20 would be fitted on a suitable hinge displacement device that ensures that the wide-angle hinge shown in FIG. 1 can be displaced in directions at right angles to one another, that is, in the arrow directions 6, 7, and 8.

The base plate 1 is upWardly covered by a hinge frame 9 that has a recess 11 on its rear end and a recess 10 on its end at the furniture door side.

A housing 25 is encased in the furniture door 21 and can be either a hinge barrel or an oblong flush-mounted housing.

The housing 25 can be secured in the furniture door 21 by any means such as screws or tap bolts.

It is important when the furniture door 21 is opened in the arrow direction 32 (see FIG. 2) that the swivel axis 16 of the furniture door 21 is displaced over the end face of the front panel 22 adjacent to the furniture door 21 in the arrow direction 18 to ensure that the furniture door 21 can be swivelled into the 180 degree position 21'.

Mounted on the housing 25 for this purpose is a gear rack 27 meshing with a gear 30, 31 pivoting on the axis 29 on a slide 13 displacing in the hinge frame 9 in the arrow directions 18, 18'.

The base plate 1 is provided on its furniture door side end with a recess 3 containing a gear rack 4. This gear rack 4 is straight and projects over the end face of the furniture unit 20, the forward end 5 of the gear rack 4 projects into the housing 25 and engages a recess 26 in the base of the housing 25.

In a preferred embodiment, the gear 30, 31 has a two-part design comprising a gear 30 with a larger diameter, which meshes with the gear rack 4, and a gear 31 with a smaller diameter, which meshes with the gear rack 27 connected with the housing 25. The gear rack 27 has a circular arc shape with a center lying in the swivel axis 16.

The advantage of a transmission gear is due to the fact that the gear 30, 31 has a two-part design and comprises the bottom larger part and the top smaller part.

In other words, the gear rack 27 is short despite the great amount of displacement in the direction (8).

According to the invention, a closing pressure device is provided in that a crankpin 24 is arranged eccentrically on the larger gear 30 and is acted upon by one end of a spring component 23.

The other end of the spring component 23 acts on a pin 19 on the slide 13.

The spring component 23 is a deflecting spring in the example embodiment shown here.

Figure 2:
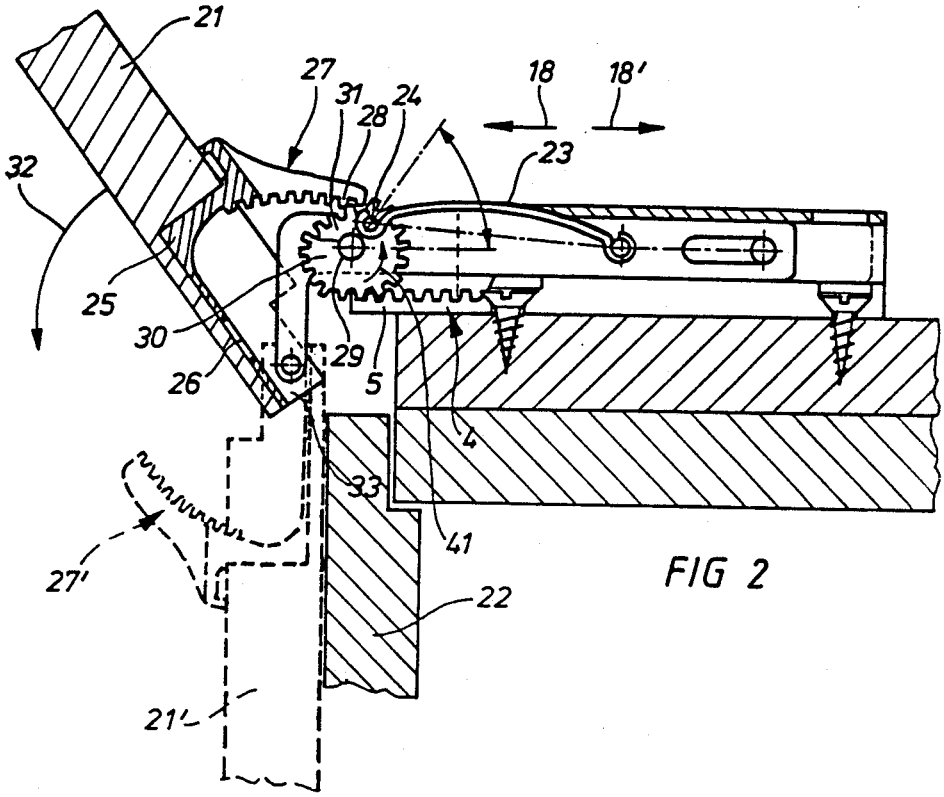
FIG. 2 shows the same hinge in an opening position with an opening angle of 45° and 180°.

To open the furniture door 21, it is swivelled in the arrow direction 32, which causes the gear rack 27 to rotate the smaller gear 31, and thus the larger gear 30 also turns and rolls on the bottom gear rack 4 as shown in FIG. 2.

In the closed position, the spring component 23 forces the crankpin 24 in the arrow direction 34 and the hinge is thus held under spring-loading in the closed position.

As soon as the furniture door swivels through an angle of about 20° to 40° according to FIG. 2, the crankpin passes the center line of the gear 30, 31 and snaps upwardly, and the rotation of the gear 30, 31 in the arrow direction 41 is thus intensified under spring loading, which facilitates the opening motion.

The door is thus given an "opening thrust", and, as soon as the gear rack 27 has reached its position according to FIG. 2, the last tooth 28 of this gear rack 27 leaves the gear 31, and the door can thus be swivelled freely for the remainder of its swivelling angle without the influence of the spring component.

The door can thus be swivelled in its position 21', for example, and the offset 15 on the furniture door side acting on the slide 13 is offset by an angle of only 90° and thus projects through the open end face of the housing 25.

The required lifting motion, that is, the displacement motion of the swivel axis 16 in the arrow direction 18 thus takes place in the transition between FIG. 1 and FIG. 2.

The displacement is limited firstly by the engagement of a pin 12, which is rigidly connected with the hinge frame 9, in an associated slot 14 in the slide 13, this slot 14 extending longitudinally in the displacement direction (arrow direction 18).

The displacement is limited secondly by the closing pressure device, that is, the spring component 23 holds the crankpin 24 in the position shown in FIG. 2, thus ensuring that the last tooth 28 will be reliably coupled with a tooth of the smaller gear 31 when the furniture door 21 is swivelled back again from its open position into the closed position.

Figure 3:
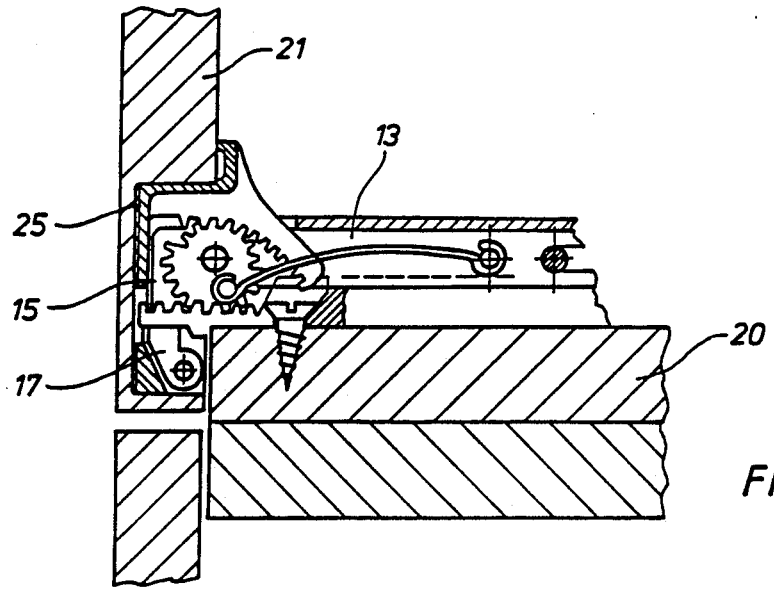
FIG. 3 is a schematic view in section of a further embodiment of the hinge.
Figure 4:
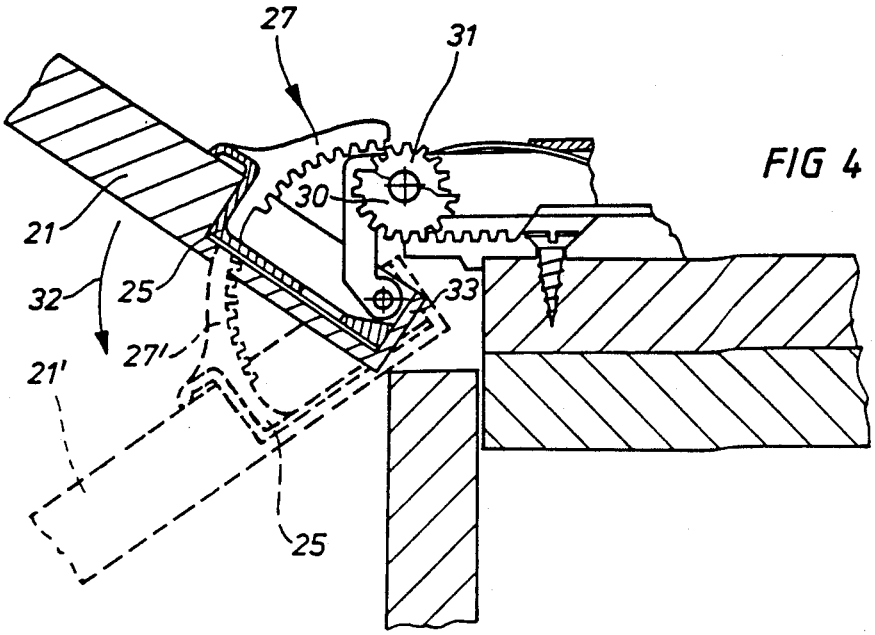
FIG. 4 shows the hinge according to FIG. 3 in two different opening positions.

The same parts have the same reference numbers in FIG. 3 and 4.

It is essential here that the offset 15 of the slide 13 is followed by a further offset 17 that is bent inward.

In accordance with FIG. 4, this ensures that the end face 33 of the housing 25 does not have to be penetrated.

Figure 5:
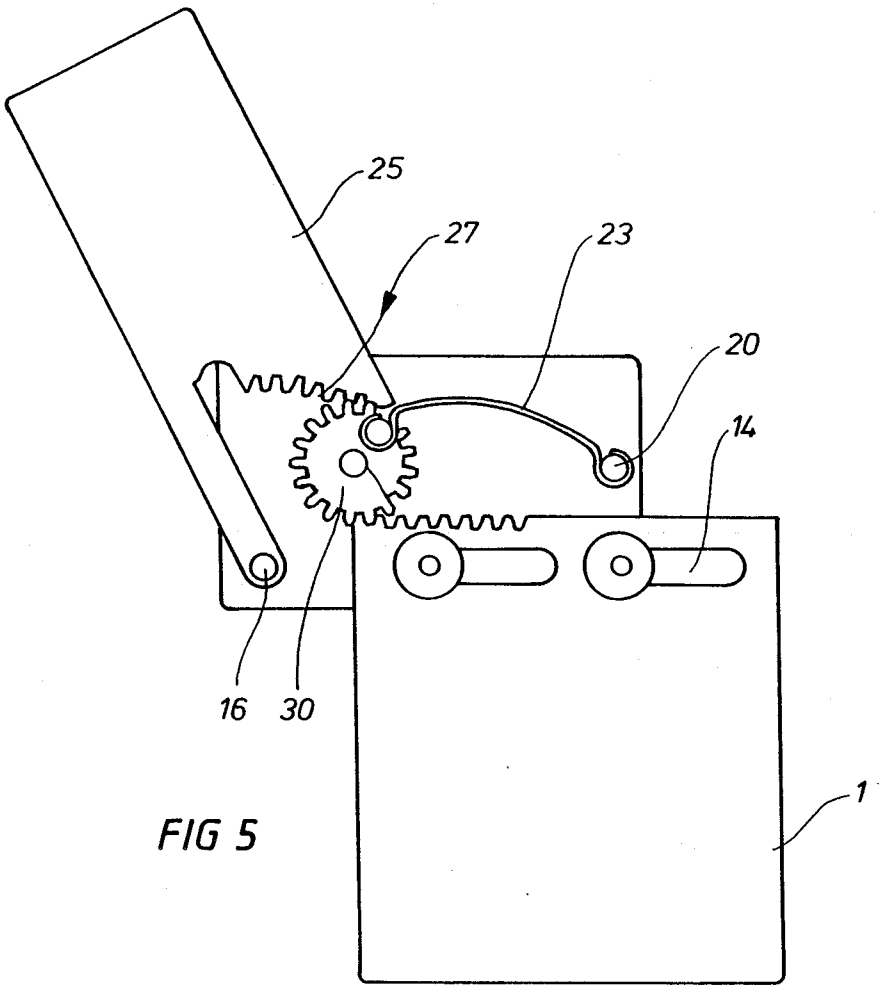
FIG. 5 is a plan view operating schematic analogous to the hinge according to FIG. 1.

FIG. 5 shows a plan view operating schematic that makes it even easier to follow the individual motions.

It shows the position of the door component 25 according to FIG. 2.

For reasons of simplicity, the housing 25 is made of a flat material.

Figure 6:
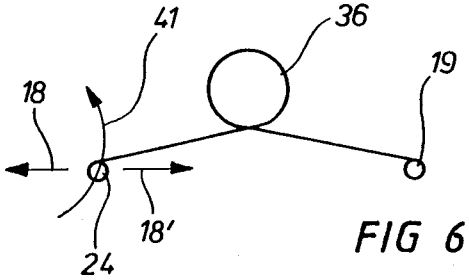
FIG. 6 is a schematic of the spring component as a leg spring.

FIG. 6 shows the spring component 23 as a leg spring 36. It can also be seen here that the crankpin 24 preloads the gear (not shown) in the one turning direction (26), while the gear is preloaded in the arrow direction 41 beyond the center line.

Figure 7:
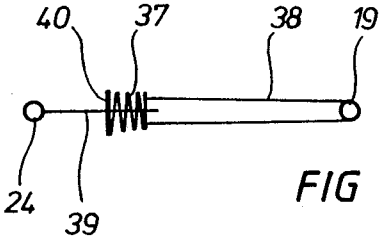
FIG. 7 is a schematic of the spring component as a coil spring.

The same effect is caused by the spring component in FIG. 7 which consists of a pin 39 with an abutment 40 on which one end of a coil spring 37 is supported, its other end being supported on the end face on the sleeve 38, the pin 39 projecting into the sleeve 38. The necessary spring tension between the pin 19 and the crankpin 24 is produced here as well.

Figure 8:
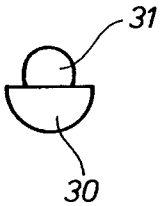
FIG. 8 is a schematic plan view of a gear comprising two pitch circles with different dimensions.

FIG. 8 also shows that the gear can be connected as one piece with two gear halves, the bottom gear 30 turning only an angle of 180° just as the top gear 31. It is a matter of course that a number of meshing gears besides the two different gears provided can be used to construct a gear drive.

The spring component 23 shown here can be attached to the gear 30 not only on one side; there ca be two spring components attached bilaterally to corresponding crankpins of the gear 30.

DRAWING LEGEND

1 Base plate
2 Screw
3 Recess
4 First gear rack
5 Forward end (gear rack 4)
6 Arrow direction
7 Arrow direction
8 Arrow direction
9 Hinge frame
10 Recess
11 Recess
12 Pin
13 Slide
14 Slot
15 Offset (FIG. 1–2)
16 Swivel axis
17 Offset (FIG. 3–4)
18 Arrow direction 18'
19 Pin
20 Furniture unit
21 Furniture door (21' is the 180 degree position)
22 Front panel
23 Spring component
24 Crankpin
25 Housing
26 Recess
27 Second gear rack
28 Tooth
29 Axis
30 Gear
31 Gear
32 Arrow direction
33 End face
34 Arrow direction
36 Leg spring
37 Coil spring
38 Sleeve
39 Pin
40 Abutment
41 Arrow direction

I claim:

1. A wide-angle hinge for articulation of a furniture door on a furniture unit comprising: a housing mounted on the furniture door; a base plate mounted on the furniture unit having a first straight gear rack with teeth oriented in a longitudinal direction rollingly receiving a gear rotating in said longitudinal direction of said first gear rack and meshing with a second gear rack connected with said housing, said second rack having a forward end at which the furniture door pivots on a swivel axis formed in said housing wherein said second gear rack is integral with said housing and having teeth oriented in a circular arc shape concentric with said swivel axis, wherein the hinge further comprising a spring device embodied in the hinge subjecting the furniture door in the closed position to a closing pressure and in open positions to an opening pressure.

2. The hinge as claimed in claim 1, wherein said spring device includes at least one crankpin mounted on said gear, a spring component generating a spring tension in the longitudinal direction of the hinge, and a pin mounted on a slide which serves as a support for said gear.

3. The hinge as claimed in claim 2 wherein said spring component is a deflecting spring, a leg spring or helical spring.

4. The hinge as claimed in claim 3 wherein said gear consists of a larger gear portion and a smaller gear portion, said larger gear portion rolling on said first gear rack and said smaller gear portion rolling on said second gear rack.

5. The hinge as claimed in claim 4 wherein said first gear rack on the furniture unit side projects into said housing on the furniture door side when the hinge is in the closed position.

6. The hinge as claimed in claim 5 wherein the longitudinal displacement of said slide is limited by a stop that holds said gear mating with said first gear rack in outermost mesh with said first gear rack when the hinge is in an open position.

7. The hinge as claimed in claim 6 wherein the rolling length of said gear is no more than 180°.

8. The hinge as claimed in claim 7 wherein said spring component on said gear acts through said crankpin as a further turning stop of said gear in an open position of the hinge in addition to said displacement stop of said slide.

9. The hinge as claimed in claim 8 wherein said slide pivoting into said housing on the furniture door side has an offset bent at an angle of about 90°.

10. The hinge as claimed in claim 9 wherein said offset has a further offset on its forward free end.

* * * * *